United States Patent [19]

McLaughlin et al.

[11] 4,164,179

[45] Aug. 14, 1979

[54] DEPOSITORY SYSTEM

[75] Inventors: Richard S. McLaughlin, Dallas; Walter Plaski, Irving; Robert F. Swartzendruber, Plano, all of Tex.

[73] Assignee: Docutel Corporation, Dallas, Tex.

[21] Appl. No.: 812,258

[22] Filed: Jul. 1, 1977

Related U.S. Application Data

[62] Division of Ser. No. 516,592, Oct. 21, 1974, Pat. No. 4,067,267.

[51] Int. Cl.[2] ..... B41J 1/44

[52] U.S. Cl. ..... 101/76; 109/24.1; 101/83

[58] Field of Search ..... 101/70, 72, 76, 78–80, 101/83; 109/24.1, 25

[56] References Cited

U.S. PATENT DOCUMENTS

| | | | |
|---|---|---|---|
| 2,148,861 | 2/1939 | Kall | 101/72 X |
| 3,056,133 | 9/1962 | Simjian | 109/24.1 X |
| 3,363,548 | 1/1968 | Aijing | 101/83 |
| 3,598,044 | 8/1971 | Hutchinson | 101/76 |
| 3,728,960 | 4/1973 | Heath | 101/76 |
| 3,836,980 | 9/1974 | Grosswiller et al. | 109/24.1 |
| 3,872,787 | 3/1975 | Danov et al. | 101/76 |

*Primary Examiner*—Edward M. Coven

*Attorney, Agent, or Firm*—Richards, Harris & Medlock

[57] ABSTRACT

Integral with a high speed, computer controlled banking machine is a depository system to provide a fully automatic teller station. At the customer interface there is an entry gate controlled to an open position by a solenoid actuated in accordance with computer generated signals. A deposit envelope inserted through the entry gate is detected by a light sensor as it moves along a pinch roller transport extending to a printing station. An envelope transported to the printing station is held in a fixed position, while a numeric print machine is acutated to imprint on the envelope identifying data. When the print cycle is completed, a computer generated signal energizes a solenoid to open a security door to a storage bin and reactuates the pinch roller transport to deliver the envelope into the storage bin. A sensor is activated when an envelope enters the storage bin, and the security door is closed and locked as the trailing edge of the envelope passes the sensor.

3 Claims, 14 Drawing Figures

DEPOSITORY SYSTEM

This is a division of application Ser. No. 516,592, filed Oct. 21, 1974 now U.S. Pat. No. 4,067,267 issued Jan. 10, 1978.

This invention relates to a banking machine, and more particularly to an automatic depository system for use with a computer controlled banking machine.

Recent studies have shown that attempts are being made by the banking community to influence the general public to use fewer checks in their financial transactions and to reduce paper work for in-bank services. This is primarily due to the difficulty of handling and processing large amounts of paper. In its place, there appears to be a wide use of credit cards for completion of daily household and business transactions.

A problem which has plagued the financial community with the increased use of credit cards is the unauthorized use of the card due to loss by the owner or theft. This particular problem has been minimized by a scrambling coding technique as described in the U.S. Pat. No. 3,662,343 of Kenneth S. Goldstein and John D. White, entitled "Credit Card Automatic Currency Dispenser".

With the risk of unauthorized use now minimized, the banking industry has accepted automatic currency dispensers for unattended distribution of cash to complete some business and personal transactions. This, financial institutions have found, provides customer convenience and eliminates the need for the construction and operation of branch banks, which are expensive and unprofitable.

A feature of the present invention is to provide a completely automatic banking system including a depository for accepting customer deposits and payments. An additional feature of the present invention is to provide a depository system in an automatic banking machine responsive to actuating signals from a computer controlled terminal machine. A depository in accordance with the present invention accepts deposit envelopes, prints a serial number on each successive envelope corresponding to the receipt serial number printed in the banking terminal and delivers the envelopes into a secured storage bin.

A depository system in accordance with the present invention is utilized in conjunction with an automatic banking machine made operational in response to the insertion of a standard class "A" credit card. Where such automatic banking machines are operated unattended, a customer is not limited to normal banking hours or required to wait on the services of a bank employee to complete teller functions. However, the unattended operation of such automatic banking machines requires a strict security operation to prevent theft of funds and documents deposited therein. This requires careful control and checking of the depository system to insure proper operation for each transaction. Of considerable importance is the entry gate which responds to the proper opening control signals and also securely closes to prevent removal of deposited envelopes. It is also important in the unattended operation of a depository system that each deposit is identified with the corresponding banking transaction.

In accordance with the present invention, an automatic document depository responds to commands from a computer controlled automatic banking terminal. The depository includes an entry gate responsive to a command from the terminal computer such that it is actuated from a locked closed position to an open position for receiving a deposit envelope. A transport for moving the deposited documents from the entry gate to a station displaced therefrom is actuated and sensors respond to document movement through the transport to sense when the document has passed the entry gate. The sensors then generate a signal to the terminal computer to actuate the gate from an open position to a closed and locked position. A document deposited and moved through the transport enters a printing station, and after completion of a printing sequence, the document is delivered through a security door into a storage bin.

A more complete understanding of the invention and its advantages will be apparent from the specification and claims and from the accompanying drawings illustrative of the invention.

Referring to the drawings.

Figure 13A:
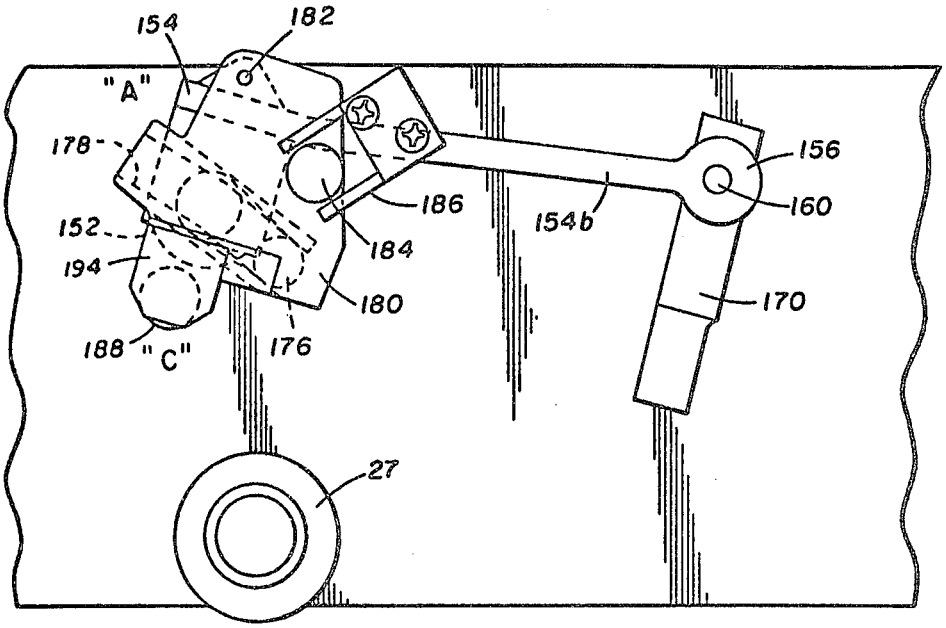
Figure 13B:
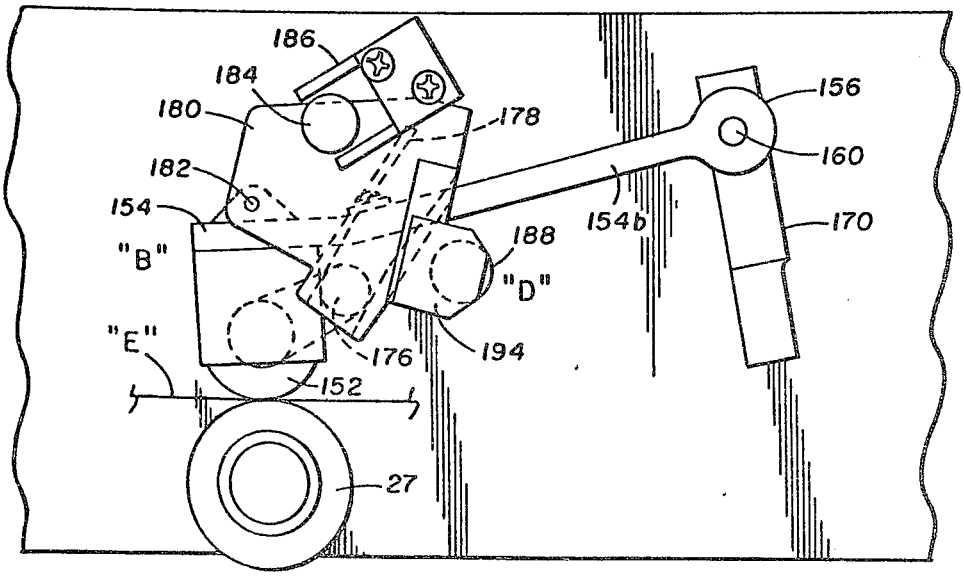

FIGS. 13*a* and 13*b* illustrate the operation of the printing mechanism in the "ready" position and the "print" position, respectively.

Figure 1:
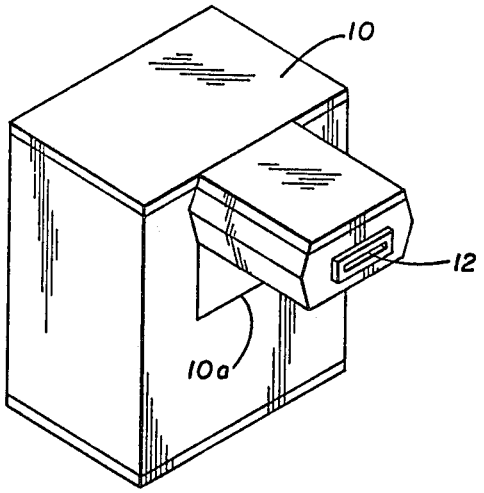
FIG. 1 is a pictorial view of a cabinet assembly containing the depository system of the present invention.

Referring to FIG. 1, there is shown a cabinet assembly 10 including the depository system of the present invention. Typically, the cabinet assembly 10 and depository system are associated with an automatic banking machine that includes a console which houses all operating controls and indicators for a currency dispenser, a card handler, a receipt/voucher printer and necessary power supplies in addition to customer interface equipment to establish control of the depository system. Such an automatic banking machine and the various customer interface equipment are described in the copending patent application of Harold Don Faught, entitled "Banking Machine" filed Apr. 12, 1972, Ser. No. 243,339.

In such an automatic banking machine, the customer equipment includes an array of push-button keys in an amount/security keyboard for use by the customer to interface with the system. In addition to the amount-/security keyboard, the customer interface equipment includes a transaction keyboard consisting of push-buttons arranged in sets for identifying the type of banking transaction to be performed by the automatic banking machine.

Figure 2:
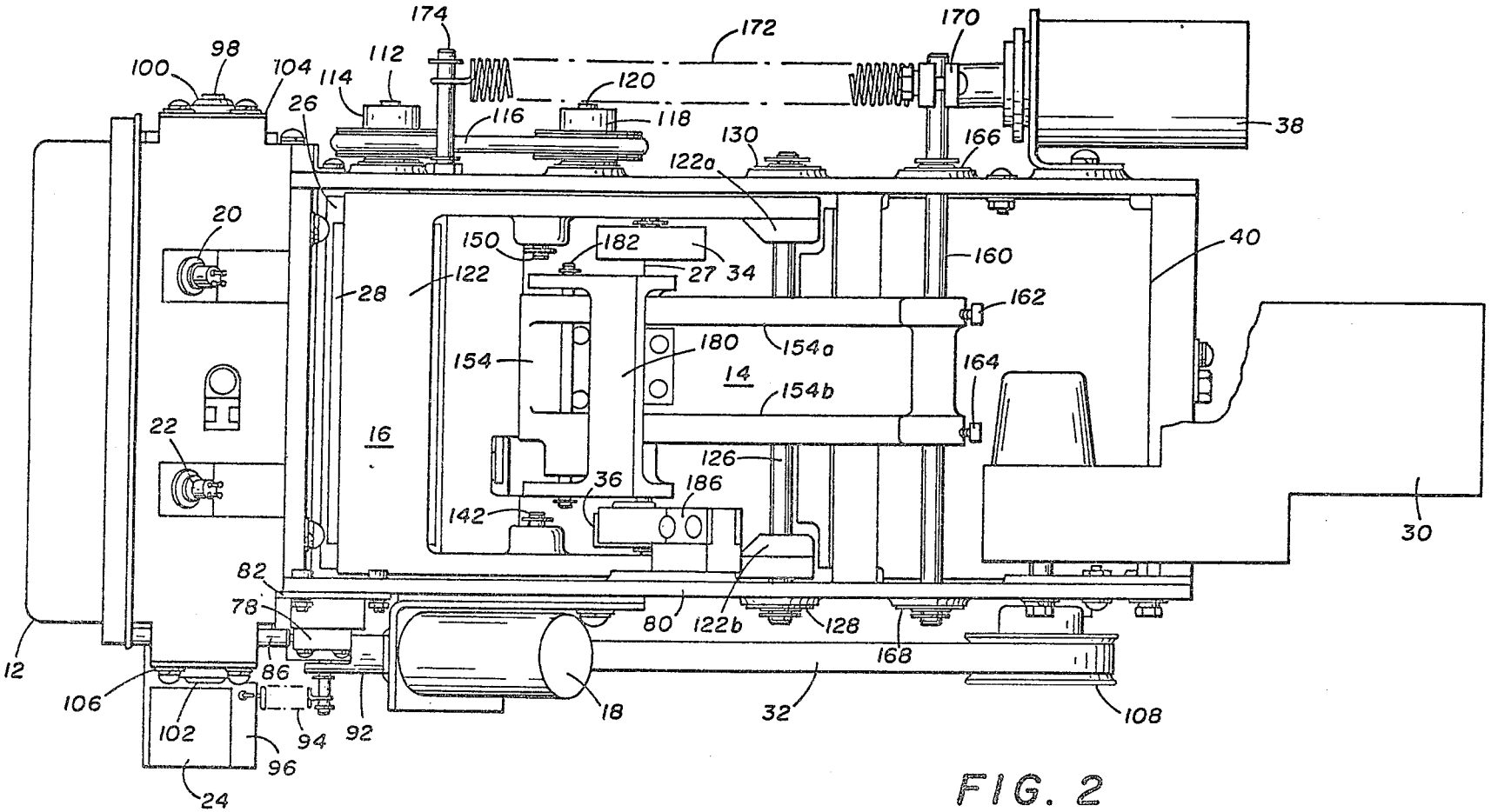
FIG. 2 is a top view of a transport system and printing mechanism for the depository system of FIG. 1.

Referring to FIG. 2, if a deposit or payment function is selected by any one of the push-buttons of the transaction keyboard, a control signal is generated by an automatic controller and transmitted to the depository system of the present invention to open an entry gate extending across the opening of the cabinet assembly 10 as a part of a throat assembly 12. In addition to the throat assembly 12, the depository system includes a printer mechanism 14 and a document transport 16.

Specifically referring to the throat assembly, it includes a security bolt (not shown) operated by a throat solenoid 18. Except when the depository system is in operation, the security bolt is locked into the closed position. After receiving a command from the automatic controller, a throat lock solenoid 24 is energized to unlock the bolt prior to energizing the throat solenoid 18 to rotate the security bolt to allow the passage of an envelope through the throat assembly 12.

An envelope inserted through the throat assembly 12 engages a front drive roller 26 and a front pinch roller 28. The drive roller 26 is driven by a gear motor 30 by means of a timing belt 32. The drive roller 26 and the pinch roller 28 deliver an envelope into the depository system where it next comes in contact with a rear drive roller 27 and pressure rollers 34 and 36.

With the envelope in the document transport, the gear motor 30 is deenergized and the envelope held stationary during operation of the printer mechanism 14. The printer mechanism is operated by a print solenoid 38 that drives the print mechanism against the stationary envelope to imprint thereon identification data. The gear motor 30 is again energized after completion of the printing operation and the envelope is delivered into a storage bin of the cabinet assembly 10.

Figure 3:
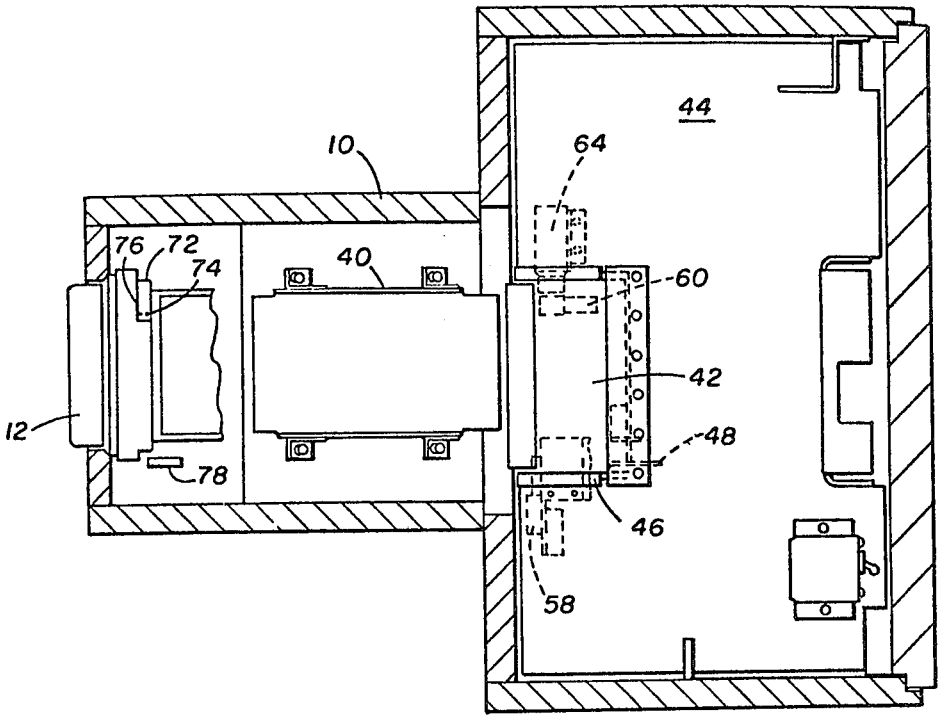
FIG. 3 is a top view of the cabinet assembly of FIG. 1 with the cover removed and partially cut away showing the depository system positioned with respect to a security door of a storage bin.

Referring to FIG. 3, there is shown in section a top view of the cabinet assembly 10 giving the location of the depository system including the throat assembly 12 with reference to a secure storage bin. After leaving the print mechanism 14 an envelope is delivered to an envelope guide 40 in the form of a downward sloping chute located in the area 10*a* of the cabinet assembly. Prior to delivery of an envelope to the envelope guide 40, a security door 42 is unlocked and opened; this door leads into a secure storage bin within the cabinet assembly 10 below a security plate 44.

Figure 4:
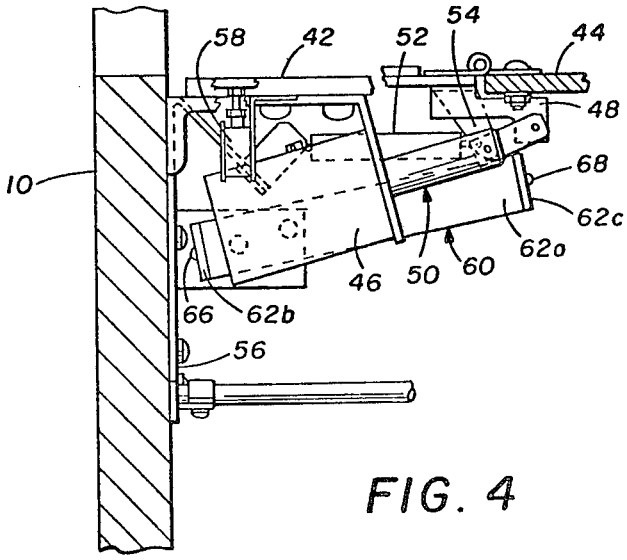
FIG. 4 is a side view in section and partially cut away showing the security door for the storage bin of FIG. 3.

Referring to FIG. 4, there is shown a detail of a security door 42 including a door solenoid 46 operationally connected to the door 42 by means of a bracket 48 pivotally connected to a solenoid arm 50. A spring 52 is used to counterbalance the door 42 to reduce the power requirements of the solenoid 46. Also controlling the opening and closing of the security door 42 is a lock mechanism including a solenoid 64 having a spring loaded plunger working into a lock bracket mounted to the door 42. At the completion of a print cycle, the solenoid 64 is energized to pull the spring loaded plunger from the lock bracket thereby unlocking the door 42 to be opened by the solenoid 46.

To monitor the operation of the security door 42, a door lock switch 58 responds to the opening and closing of the door to determine the locked condition thereof. Contact closures and openings within the switch 58 are sensed by electronics in the depository to generate a signal to the automatic controller.

As an envelope drops from the envelope guide 40 through the security door 42 and into the secure storage bin of the cabinet assembly 10, it interrupts an optical switch sensor 60 positioned below the security door. The optical switch sensor 60 consists of the U-shaped bracket having a base 62*a* and two side members 62*b* and 62*c*. The U-shaped bracket is attached to a sensor bracket mounted to the wall of the cabinet assembly 10. Assembled within the arm 62*b* is a light emitting diode 66 generating a light beam to a phototransistor 68. An envelope passing through the security door 42 interrupts the light beam from the diode 66 to the phototransistor 68 thereby generating a signal to the automatic controller thereby indicating that an envelope has entered the storage bin. This causes a signal to be generated to the solenoids 46 and 64 to return the security door 42 to a closed and locked position.

Figure 5:
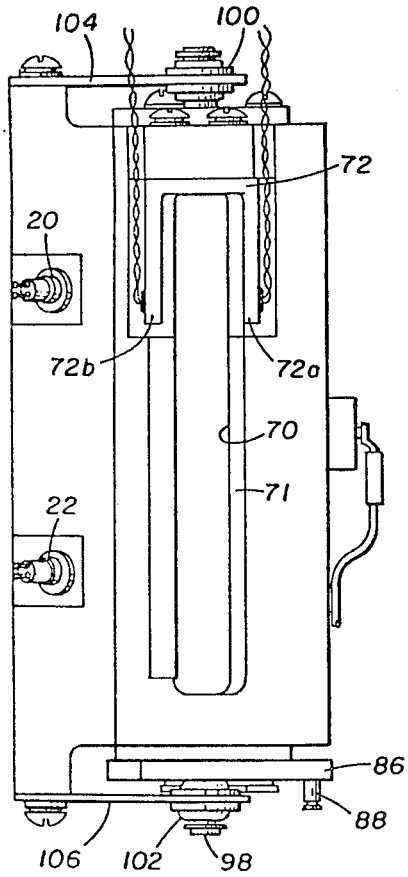
FIG. 5 is a view of the entry throat from the transport system side showing the arrangement of envelope sensors.
Figure 6:
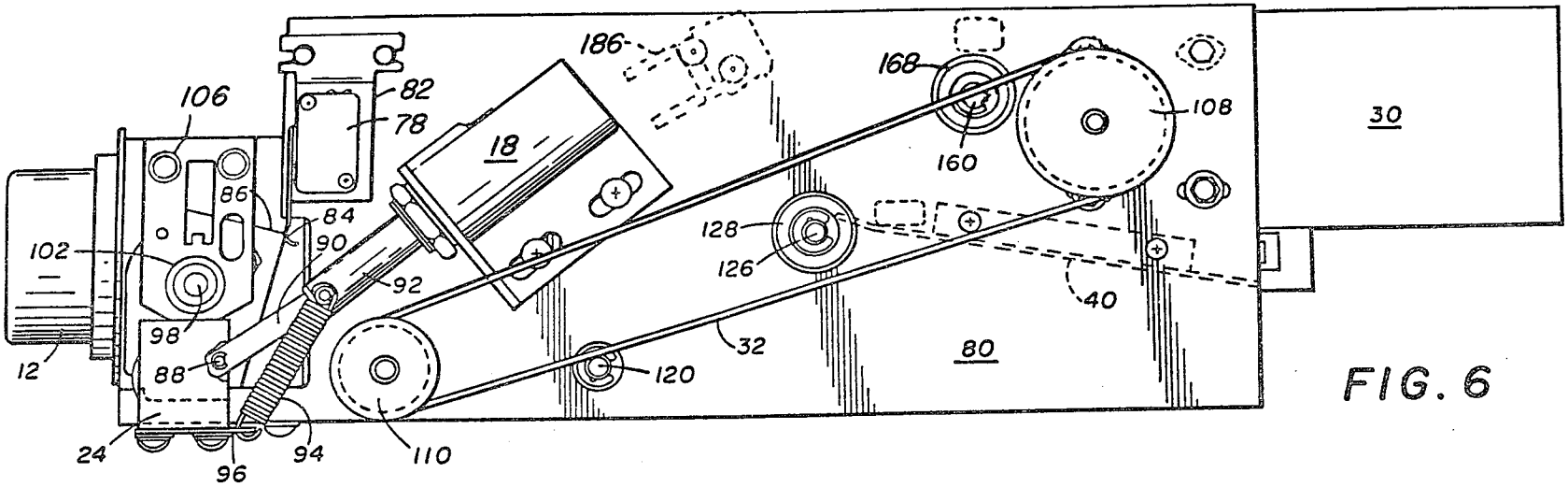
FIG. 6 is a right side view of the depository system showing the entry gate control and transport belt drive.

Referring to FIGS. 5 and 6, an envelope inserted through the throat assembly 12 passes through an open throat 70 formed in a security bolt 71 and is sensed by detectors mounted to a sensor bracket 72. As shown in FIG. 3, two sensors 74 and 76 are positioned along the path of an envelope passing through the throat assembly. The sensors 74 and 76 are typically phototransistors responding to a light beam from a light emitting diode assembled into the arm 72*a* of the bracket 72 opposite the arm 72*b* containing the sensors 74 and 76. Signals from the sensors 74 and 76 are transmitted to the automatic controller to monitor the passing of an envelope into the depository system.

In addition to signals from the sensors 74 and 76, the automatic controller also receives a switch closure signal from a microswitch sensor 78. The switch 78 is mounted to the right side wall 80 by means of a switch bracket 82 and responds to the opening and closing of the security bolt 71. The switch arm 84 of the switch 78 is in contact with a throat cam 86 as part of the mechanism controlling the opening and closing of the security bolt 71. The throat cam 86 has a generally rectangular configuration with a coupling pin 88 extending from a lower section thereof. The pin 88 is pivotally connected to a throat lock link 90 extending from a plunger 92 of the throat open solenoid 18. The solenoid plunger is spring loaded into the position shown by means of a throat lock spring 94 having one end connected to the plunger 92 and a second end connected to a bracket 96 supporting the throat lock solenoid 24.

As shown in FIG. 5, the security bolt 71 is mounted to rotate on a shaft 98 that extends through floating bearings 100 and 102 supported in bearing brackets 104 and 106. The throat cam 86 is fixed to the shaft 98.

An envelope detected by the sensors 74 and 76 causes a signal to be generated to energize the gear motor 30 to rotate the front drive roller 26 through the timing belt 32 that engages a timing belt pulley 108, coupled to the output shaft of the motor, and a drive pulley 110, coupled to a shaft 112 supporting the front drive roller 26. Attached to the roller shaft 112 opposite the pulley 110 is a drive pulley 114 having a drive belt 116 in engagement therewith. The drive belt 116 also engages a drive pulley 118 coupled to a driven roller shaft 120 extending through the frame of the depository system. Supported on the driven roller shaft 120 is the rear drive roller 27 engaging the pressure rollers 34 and 36.

Figure 7:
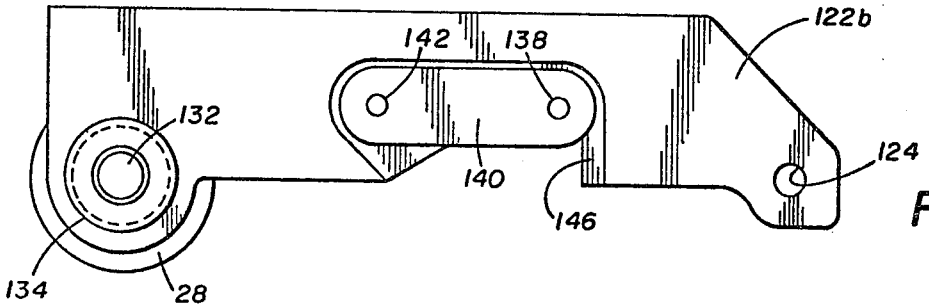
FIG. 7 is a side view of a pivoted pinch roller assembly for the transport system.
Figure 8:
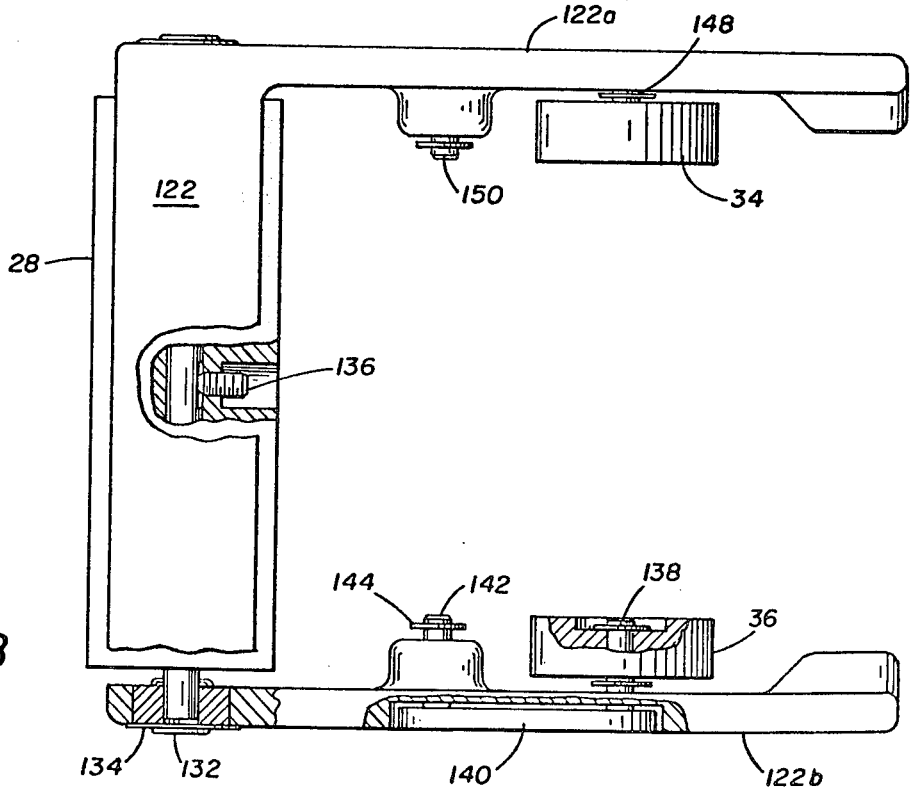
FIG. 8 is a top view, partially cut away, showing the pivoted pinch roller assembly including opposed side pressure rollers.

Referring to FIGS. 7 and 8, the pinch roller 28 and the pressure rollers 34 and 36 are maintained in position with respect to the front drive roller 26 and the rear drive roller 27 by means of a U-shaped pinch roller assembly 122 having a pinch roller arm 122*a* and a pinch roller arm 122*b*. Each of the pinch roller arms 122*a* and 122*b* includes a bearing, such as the bearing 124 for the arm 122*b*, that provides a pivotal support for the pinch roller 122 by means of a pinch roller shaft 126. The pinch roller shaft 126 extends through bearings 128 and 130 in opposite side walls of the depository frame.

A pinch roller shaft 132 extends through the pinch roller assembly 122 and is rotatably carried by bearings, such as bearing 134 in the arm 122*b*. Fastened to the pinch roller shaft 132 by means of a locking set screw 136 is the pinch roller 28. With the pinch roller assembly 122 mounted in the depository frame on the shaft 126, the weight of the assembly causes the pinch roller 28 to be maintained in contact with the front drive roller 26.

Positioned between the pinch roller 28 and the pinch roller shaft 126 are the pressure rollers 34 and 36. Each of these rollers is rotatably mounted independently to the pinch roller arms 122*a* and 122*b*, respectively. With reference to the pressure roller 36, it is supported on a pressure roller shaft 138 extending from a pressure roller arm 140. At the end of the roller arm 140 opposite the shaft 138 there is a pivot shaft 142 that extends through a bearing in the roller arm 122*b* and is secured therein by means of a fastener 144. Thus, the pressure roller 36 is rotatably mounted with respect to the pinch roller arm 122*b*. To accommodate the rotation of the pressure roller 36, the pinch roller arm 122*b* includes a cutout 146.

A similar pressure roller arm pivotally mounted to the pinch roller arm 122*a* is provided for the pressure roller 34. This roller is supported on a shaft 148 with the pressure roller arm rotatably mounted to the pinch roller arm 122*a* by means of a shaft 150.

Thus, both the pressure rollers 34 and 36 are free to rotate not only with respect to the pinch roller assembly 122 but also with respect to the depository frame. This allows the pressure rollers 34 and 36 to be in contact with the rear driven roller 27.

Referring to FIGS. 9–12, an envelope inserted through the throat 70 engages the front drive roller 26 and the pinch roller 28 to be transported into the depository system to subsequently be engaged by the pressure rollers 34 and 36 and the rear drive roller 27. When the envelope is positioned below the print mechanism 14, the gear motor 30 is deenergized and the envelope held stationary.

At this time, identification numbers are imprinted on the envelope by the print mechanism 14 that includes a print machine 152 rigidly attached to a printhead assembly 154 having reinforcing ribs 154*a* and 154*b*. At the ends of the ribs 154*a* and 154*b* the printhead assembly 154 includes a spool-shaped bearing housing 156 having a bore 158 extending therethrough. The printhead assembly 154 is rigidly attached to an actuation shaft 160 inserted through the bore 158 and secured thereto by means of cap screws 162 and 164 as shown in FIG. 2. The actuation shaft 160 extends through bearings 166 and 168 in the side walls of the depository frame.

Figure 9:
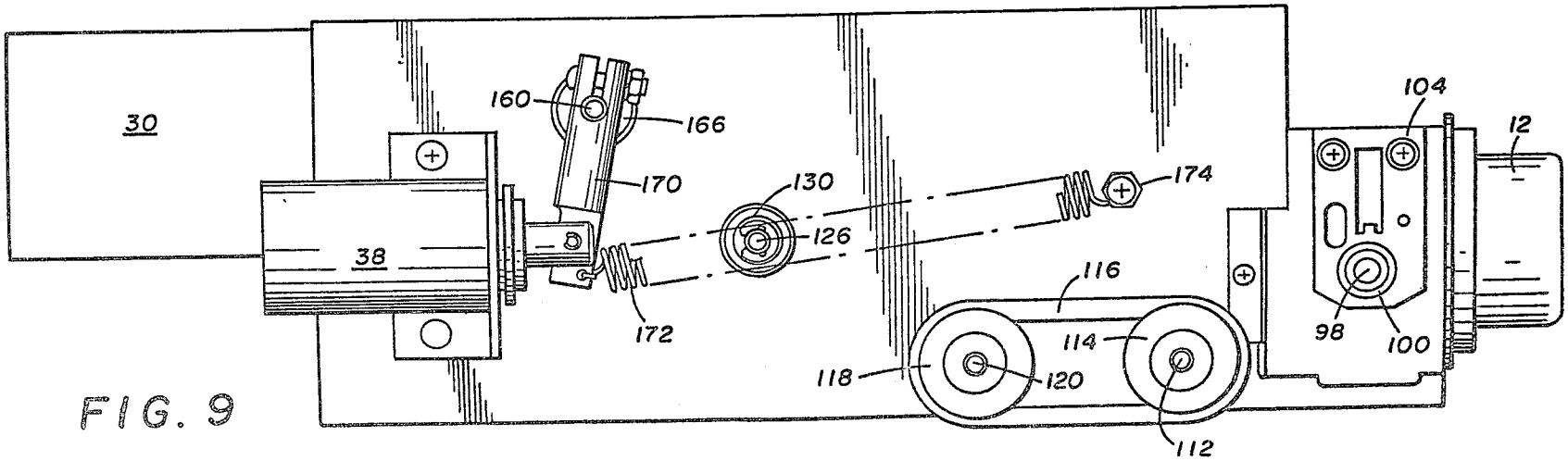
FIG. 9 is a left side view of the depository system showing a solenoid control for operating a print machine.
Figure 10:
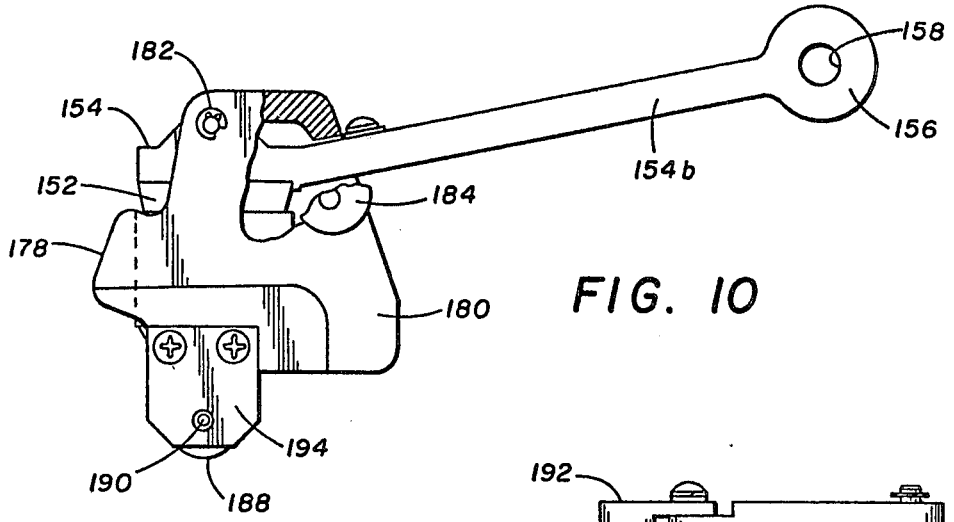
FIG. 10 is a side view, partially cut away, showing the printing mechanism of FIG. 2.
Figure 11:
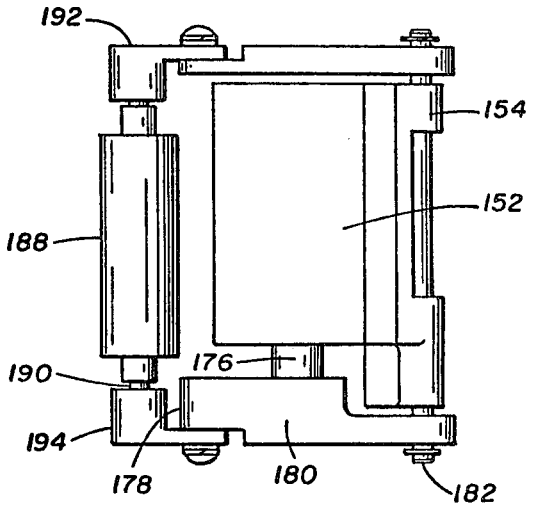
FIG. 11 is a front view of the printing mechanism of FIG. 10 showing the relationship between a print machine and an inking roller.
Figure 12:
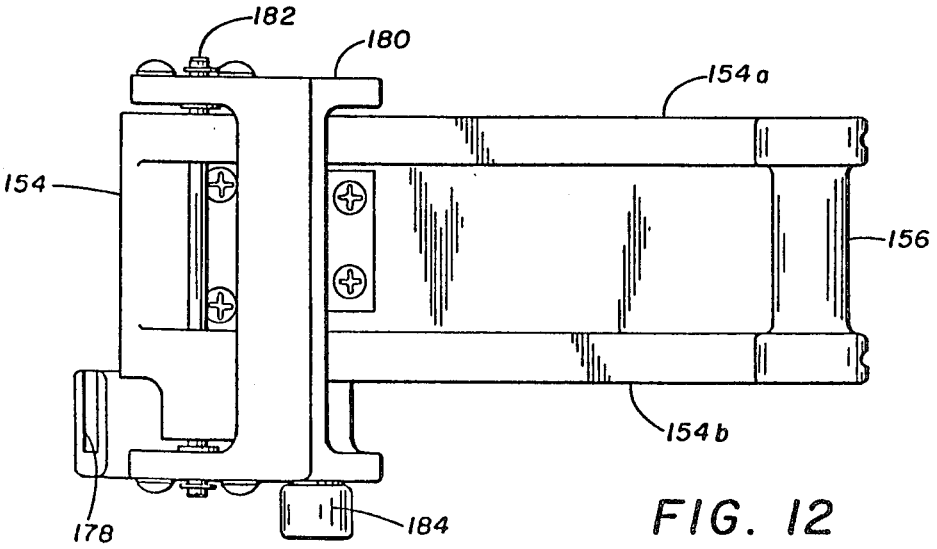
FIG. 12 is a top view of the printing mechanism of FIG. 10.

With reference to FIG. 9, at one end of the actuation shaft 160 there is clamped an actuation arm 170 that is pivotally coupled to the print solenoid 38. This solenoid receives energizing signals from the automatic controller to rotate the actuation arm 170 into the position shown in FIG. 9. Upon the deenergization of the solenoid 38 the actuation arm 170 is rotated counterclockwise by means of a print arm return spring 172 having one end connected to the actuation arm and the opposite end secured to the side wall of the depository frame by means of a mounting screw 174. Thus, actuating the solenoid 38 drives the print machine 152 against an envelope in the depository system and the print arm return spring 172 then lifts the print machine from the envelope upon the completion of a printing sequence.

Each time the print machine is actuated the identification data must be indexed to provide a sequential order of identification numbers. To index the print machine 152, an indexing lever 176 is included as a part of a conventional print machine and engages a cam race 178 as part of a print roller carrier 180. The print roller carrier 180 is pivotally attached to the printhead assembly 154 by means of a printhead shaft 182. Extending from one side of the print roller carrier 180 is a cam roller 184 that cooperates with the cam race 186 (referring to FIG. 6) that completes the mechanism for indexing of the print machine 152. The cam race 186 is attached to the side wall of the depository frame to provide a fixed reference for the indexing mechanism.

Also carried by the print roller carrier 180 is an ink roller 188 mounted on a shaft 190 rotating in bearings of ink roller brackets 192 and 194 attached to the roller carrier. The ink roller 188 includes a supply of a printing ink that is spread over the characters of the print machine after each print operation.

Referring to FIGS. 13*a* and 13*b*, there is schematically shown the print mechanism 14 in the print ready position in FIG. 13*a* and the print position in FIG. 13*b*. The print actuation arm 170 is schematically illustrated connected to the printhead assembly 154. In the print ready position, the print arm assembly is rotated to position "A" and the ink roller 188, as attached to the print roller carrier 180, is in position "C" and in contact with the print machine 152. The indexing lever 176 is at the far right end of the cam race 178 and the cam roller 184 is constrained within the cam race 186. The relative position of the print mechanism 14 may be visualized by the schematic illustration of the rear driven roller 27.

Upon energizing the print solenoid 38, the print actuation arm 170 rotates the printhead assembly 154 into position "B" as shown in FIG. 13*b*. The print machine 152 is driven in contact with an envelope "E" positioned over the rear drive roller 27. As the printhead assembly 154 rotates counterclockwise, the cam roller 184 rotates within the cam race 186. Its position within the race, however, remains relatively stationary. Since this fixes the position of the print roller carrier 180 with respect to the cam race 186, it is forced to rotate counterclockwise with respect to the print machine 152 by means of the pivotal connection of the printhead shaft 182. Rotating the print roller carrier 180 counterclockwise with respect to the print machine 152 causes the indexing lever 176 to also rotate counterclockwise with respect to the print machine which causes the lever to travel in the cam race 178. This cocks the print machine 152 ready for indexing upon a clockwise movement of the indexing lever 176. At this time, the ink roller 188, as attached to the print roller carrier 180, rotates to the position "D" away from the printing machine 152.

The print solenoid 38 is energized from the automatic controller for a preset time interval sufficient to allow the print cycle to be completed. It is then deenergized and the print arm return spring 172 rotates the print actuation arm 170 clockwise into the position shown in FIG. 13*a*. The print roller carrier 180 now rotates clockwise with respect to the print machine 152 by action of the cam roller 184 and the cam race 186. The indexing lever 176 also rotates clockwise with respect to the print machine 152 thereby indexing the identification number by one. The ink roller 188 again rotates to position "C" in contact with the print machine 152 to again spread ink on the identification numbers for a subsequent printing operation.

The above operation for the print machine 152 repeats each time an envelope is inserted through the throat assembly 12. Each envelope thus inserted is printed with an identification number that has a sequential order with respect to previously inserted envelopes.

While only one embodiment of the invention, together with modifications thereof, has been described in detail herein and shown in the accompanying drawings, it will be evident that various further modifications are possible without departing from the scope of the invention.

What is claimed is:

1. A character printer in an automatic document depository having a supporting frame and wherein transport means moves the document to a print station, comprising:

A printhead assembly having one end rotatably mounted to the supporting frame of said document depository, a printing machine having sequentially varying characters and attached to the printhead assembly at a position displaced from one end, a carrier housing pivotally mounted to said printhead assembly and having at least one side (end plate) extending past (one side of) said printing machine, said carrier housing including a cam roller as a part thereof, a first cam follower attached to the supporting frame in a fixed position relative to the rotatably mounted one end of said printhead assembly and in engagement with said cam roller, a second cam follower as an integral part of the one side (plate) of said carrier housing at a position displaced from (the one side of) said printing (print) machine, an indexing lever connected to said printing machine and in engagement with the second cam follower, said indexing lever to be actuated by the cooperation of said indexing lever with said second cam follower to sequentially vary the character arrangement of said printing machine, and means for rotating said printhead assembly from a first position to a second position to move said printing machine into (in) contact with a document at the print station, and to pivot said carrier housing by cooperation of the cam roller with said first cam follower thereby indexing said printing machine by actuating said indexing lever through cooperation with the second cam follower.

2. A character printer in an automatic document depository as set forth in claim 1 including inking means attached to said carrier housing to be positioned therewith to contact the characters of said printing machine when the assembly is in the first position.

3. A character printer in an automatic document depository as set forth in claim 1 wherein said means for rotating includes means for biasing said printhead assembly into the first position.

* * * * *

UNITED STATES PATENT AND TRADEMARK OFFICE

CERTIFICATE OF CORRECTION

PATENT NO. : 4,164,179

DATED : August 14, 1979

INVENTOR(S) : Richard S. McLaughlin et al

It is certified that error appears in the above-identified patent and that said Letters Patent are hereby corrected as shown below:

Column 8, line 2, after "side" delete "(end plate)";
line 3, after "past" delete "(one side of)";
line 11, after "side" delete "(plate)";
line 12, after "from" delete "(the one side of)";
line 12, after "printing" delete "(print)";
line 21, after "into" delete "(in)".

Signed and Sealed this

*Twenty-ninth* Day of *January 1980*

[SEAL]

*Attest:*

SIDNEY A. DIAMOND

*Attesting Officer*

*Commissioner of Patents and Trademarks*